US011579553B2

(12) United States Patent
Abe

(10) Patent No.: US 11,579,553 B2
(45) Date of Patent: Feb. 14, 2023

(54) PHOTO-INTERRUPTOR UNIT, SHEET CONVEYANCE APPARATUS AND IMAGE FORMING APPARATUS

(71) Applicant: CANON KABUSHIKI KAISHA, Tokyo (JP)

(72) Inventor: Hideto Abe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 125 days.

(21) Appl. No.: 16/851,151

(22) Filed: Apr. 17, 2020

(65) Prior Publication Data

US 2020/0356036 A1 Nov. 12, 2020

(30) Foreign Application Priority Data

May 10, 2019 (JP) ..... JP2019-090180

(51) Int. Cl.
*G03G 15/00* (2006.01)
*G03G 21/16* (2006.01)

(52) U.S. Cl.
CPC ..... *G03G 15/5029* (2013.01); *G03G 21/1695* (2013.01); *G03G 2215/00721* (2013.01); *G03G 2221/1606* (2013.01)

(58) Field of Classification Search
CPC ..... G03G 15/5029; G03G 21/1695; G03G 2215/00721; G03G 2221/1606; G03G 2215/00616; G03G 2215/00628
See application file for complete search history.

(56) References Cited

U.S. PATENT DOCUMENTS 5,338,435 A * 8/1994 Betts ..... A61B 5/15003 204/406
6,399,943 B1 * 6/2002 Sano ..... H01L 31/0203 250/239
6,677,580 B1 * 1/2004 Sano ..... H01L 31/16 250/239
9,312,403 B2 * 4/2016 Miyata ..... H01L 31/167
10,139,761 B2 11/2018 Abe et al.
(Continued)

FOREIGN PATENT DOCUMENTS

JP 2018-034935 A 3/2018

*Primary Examiner* — David H Banh
(74) *Attorney, Agent, or Firm* — Venable LLP

(57) ABSTRACT

A photo-interruptor unit includes a photo-interruptor and a supporting portion to detachably support the photo-interruptor. The supporting portion includes a hole which is formed on an attaching surface and through which a hook portion is inserted, and a guide portion to protrude from the attaching surface and guide the hook portion so that it deforms in a deformation direction when the photo-interruptor is moved in a movement direction intersecting an insertion direction. A regulating portion protrudes from the attaching surface and forms continuously with the guide portion to regulate a position in the movement direction of the photo-interruptor. The guide portion includes a first rib portion and a second rib portion that oppose one another in the deformation direction, and a distance between the first rib portion and the second rib portion in the deformation direction narrows toward a downstream direction of the movement direction.

12 Claims, 9 Drawing Sheets

(56) References Cited

U.S. PATENT DOCUMENTS

| | | | | |
|---|---|---|---|---|
| 2006/0065818 | A1* | 3/2006 | Shimokawa | G01V 8/20 250/221 |
| 2008/0210952 | A1* | 9/2008 | Wada | H01L 31/0203 257/82 |
| 2015/0157196 | A1* | 6/2015 | Van Der Mark | H01R 43/002 134/104.1 |
| 2018/0059601 | A1* | 3/2018 | Abe | G03G 21/16 |

* cited by examiner

PHOTO-INTERRUPTOR UNIT, SHEET CONVEYANCE APPARATUS AND IMAGE FORMING APPARATUS

BACKGROUND OF THE INVENTION

Field of the Invention

The present invention relates to a photo-interruptor unit including a photo-interruptor, a sheet conveyance apparatus and an image forming apparatus equipped with the same.

Description of the Related Art

Generally, a photo-interruptor provided on an apparatus such as a pachinko game machine, a camera or a printer is known to detect the presence of a detection target by switching light irradiated from a light emitting component between a state reaching a photosensing portion and a state not reaching the same. One example of a photo-interruptor provided on a printer is a photo-interruptor that detects the presence of a sheet by blocking light emitted from the light emitting component to the photosensing portion by a flag that moves by being pressed by a sheet being conveyed. The photo-interruptor is fixed by an elastically deformable hook portion being fit to an engagement hole by so-called snap-fitting.

In mass production processing of snap-fitting the hook portion, if external force is applied unintentionally by an operator to the photo-interruptor that has been engaged properly, engagement failure may occur where the snap-fit photo-interruptor is disengaged or semi-engaged. If this engagement failure is revealed after completing assembling of associated parts, the unit including the photo-interruptor must be discarded as a defective product or the unit must be disassembled and reassembled, so that there was much loss and deterioration of productivity.

Meanwhile, Japanese Patent Application Laid-Open Publication No. 2018-34935 discloses a photo-interruptor unit having a guide rib provided on a side surface of a photo-interruptor, and capable of suppressing engagement failure of snap-fitting caused by external force. Specifically, in Japanese Patent Application Laid-Open Publication No. 2018-34935, the position of the photo-interruptor receiving external force in a short length direction of the photo-interruptor may be regulated by being abutted against a guide rib, and thereby, disengagement of snap-fitting is suppressed.

The photo-interruptor unit disclosed in Japanese Patent Application Laid-Open Publication No. 2018-34935 enables to suppress disengagement of the photo-interruptor after the fitting operation. However, if the snap-fitting component is erroneously bumped against an area close to the engagement hole during snap-fitting to the engagement hole, the snap-fitting component may be bent or damaged.

SUMMARY OF THE INVENTION

According to one aspect of the present invention, a photo-interruptor unit includes a photo-interruptor including a light emitting component configured to emit light, a photosensing portion configured to receive light emitted from the light emitting component, and a hook portion configured to deform elastically in a deformation direction, and a supporting portion configured to detachably support the photo-interruptor. The supporting portion includes an attaching surface to which the photo-interruptor is attached, a hole which is formed on the attaching surface and through which the hook portion is inserted in an insertion direction, a guide portion configured to protrude from the attaching surface and configured to guide the hook portion so that the hook portion deforms in the deformation direction in a state where the photo-interruptor is moved in the deformation direction and a movement direction intersecting the insertion direction to be attached to the supporting portion, and a regulating portion configured to protrude from the attaching surface and configured to regulate a position in the movement direction of the photo-interruptor whose hook portion has been guided by the guide portion to a position where the hook portion is overlapped with the hole.

Further features of the present invention will become apparent from the following description of exemplary embodiments with reference to the attached drawings.

DESCRIPTION OF THE EMBODIMENTS

First Embodiment

Overall Configuration

Figure 1:
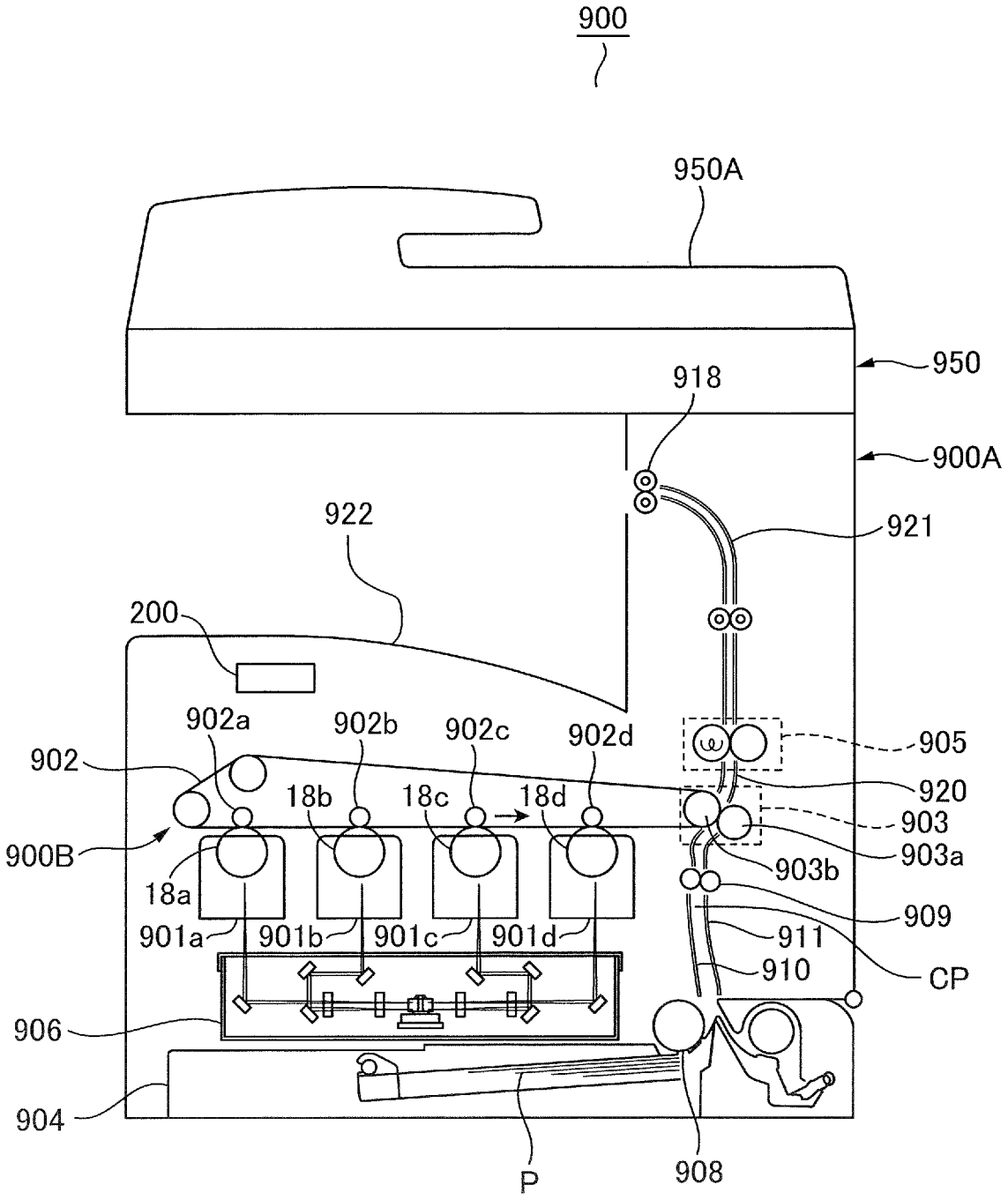
FIG. 1 is a general schematic view of a printer according to a first embodiment.

FIG. 1 is an entire schematic diagram illustrating a configuration of a printer of an electrophotographic system according to a first embodiment. As illustrated in FIG. 1, a printer 900, i.e., image forming apparatus, includes a printer main body, hereinafter referred to as apparatus body 900A including an image forming unit 900B for forming an image on a sheet, and an image reading apparatus 950 including a document conveyance apparatus 950A.

Now, the image forming unit 900B includes photosensitive drums 18*a*-18*d* that forms toner images of four colors, which are yellow, magenta, cyan and black, and an exposing unit 906 that forms an electrostatic latent image on a photosensitive drum by irradiating laser beams based on image information. The photosensitive drums 18*a*-18*d* are driven by a motor not shown, and on the circumference of each photosensitive drum is arranged a primary charger, a developer and a transfer charger, which are formed into units as process cartridges 901*a*-901*d*.

Further, the image forming unit 900B includes an intermediate transfer belt 902 which is driven to rotate in an arrow direction in FIG. 1, and a secondary transfer portion 903 for transferring a full-color image formed on the intermediate transfer belt 902 to a sheet P. By applying transfer bias to the intermediate transfer belt 902 from transfer chargers 902*a*-902*d*, toner images of respective colors on the photosensitive drum are transferred in multiple layers on the intermediate transfer belt 902. Thereby, a full-color image is formed on the intermediate transfer belt 902.

The secondary transfer portion 903 is composed of a secondary transfer counter roller 903*b* configured to support the intermediate transfer belt 902, and a secondary transfer roller 903*a* that abuts against the secondary transfer counter roller 903*b* via the intermediate transfer belt 902. Further, a sheet feeding cassette 904 is arranged below the image forming unit 900B, and the sheet P stacked on the sheet feeding cassette 904 is fed by a pickup roller 908 that serves as a conveyance portion configured to convey a sheet according to the present embodiment. Further, a registration roller 909 is provided downstream in the conveyance direction of the pickup roller 908. A control unit 200 is provided on the apparatus body 900A.

Next, an image forming operation of the printer 900 configured as above will be described. In a state where the image forming operation is started, the exposing unit 906 irradiates laser beams based on image information from a personal computer and the like not shown, by which the photosensitive drums 18*a*-18*d* whose surfaces are charged uniformly are exposed sequentially to form electrostatic latent images on the photosensitive drums 18*a*-18*d*. Thereafter, the electrostatic latent images are developed by toner and visualized.

For example, a laser beam based on an image signal corresponding to yellow color component in the document is irradiated on the photosensitive drum 18*a* using a polygon mirror and the like of the exposing unit 906. A yellow electrostatic latent image is developed using yellow toner from the developer and visualized as yellow toner image. Thereafter, the toner image reaches a primary transfer portion where the photosensitive drum 18*a* and the intermediate transfer belt 902 contact each other by rotation of the photosensitive drum 18*a*. In a state where the toner image reaches the primary transfer portion, primary transfer bias applied to the transfer charger 902*a* causes the yellow toner image on the photosensitive drum 18*a* to be transferred to the intermediate transfer belt 902.

Next, similarly as the method described above, magenta toner image, cyan toner image and black toner image formed on the photosensitive drums 18*b*-18*d* are transferred on top of the yellow toner image borne on the intermediate transfer belt 902. Thereby, a full-color toner image is formed on the intermediate transfer belt 902.

Further, simultaneously as the toner image forming operation, the sheet P stored in the sheet feeding cassette 904 is sent out one sheet at a time by the pickup roller 908. Then, the sheet P passes between the conveyance guides 910 and 911 to reach the registration roller 909, where skewing of the sheet P is corrected by the registration roller 909, and then the sheet is conveyed to the secondary transfer portion 903. Thereafter, in the secondary transfer portion 903, the toner images of four colors formed on the intermediate transfer belt 902 are collectively transferred to the sheet P by secondary transfer bias applied on the secondary transfer roller 903*a*.

Next, the sheet P to which the toner image has been transferred is guided from the secondary transfer portion 903 to a conveyance guide 920 and conveyed to a fixing portion 905, and when passing through the fixing portion 905, the sheet receives heat and pressure by which the toner image is fixed. Thereafter, the sheet P to which the toner image has been fixed passes through a sheet discharge conveyance guide 921 provided downstream of the fixing portion 905 in a conveyance direction, and thereafter, the sheet is discharged onto a sheet discharge tray 922 by a sheet discharge roller pair 918.

Photo-Interruptor and Flag Unit

Figure 2A:
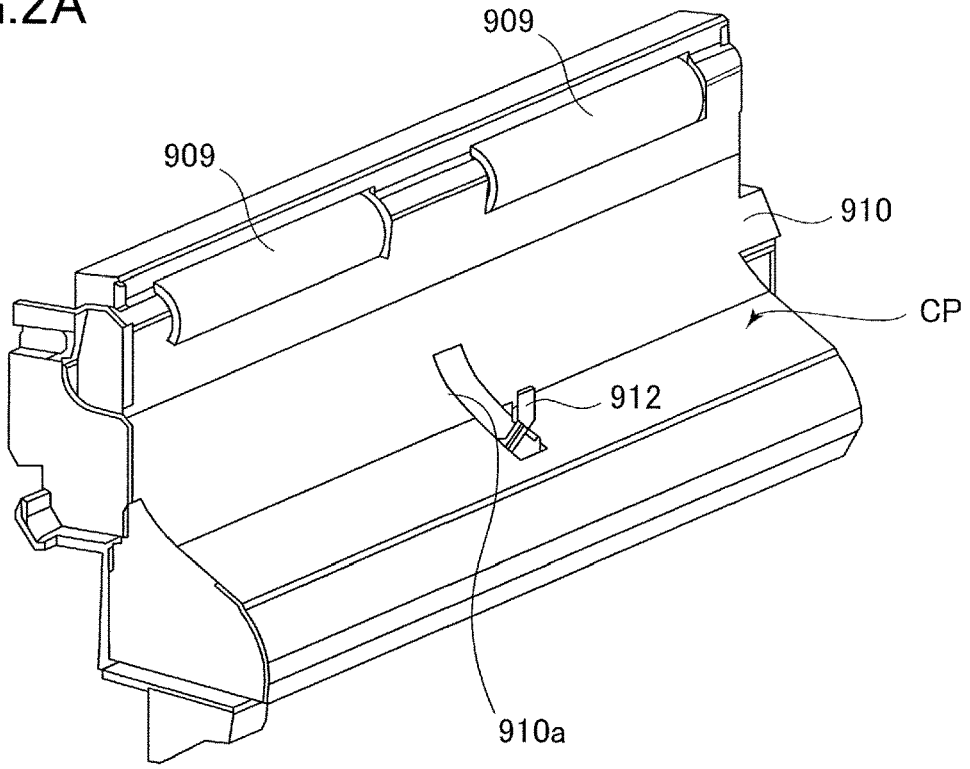
FIG. 2A is a perspective view of a conveyance guide and a sensor flag.
Figure 2B:
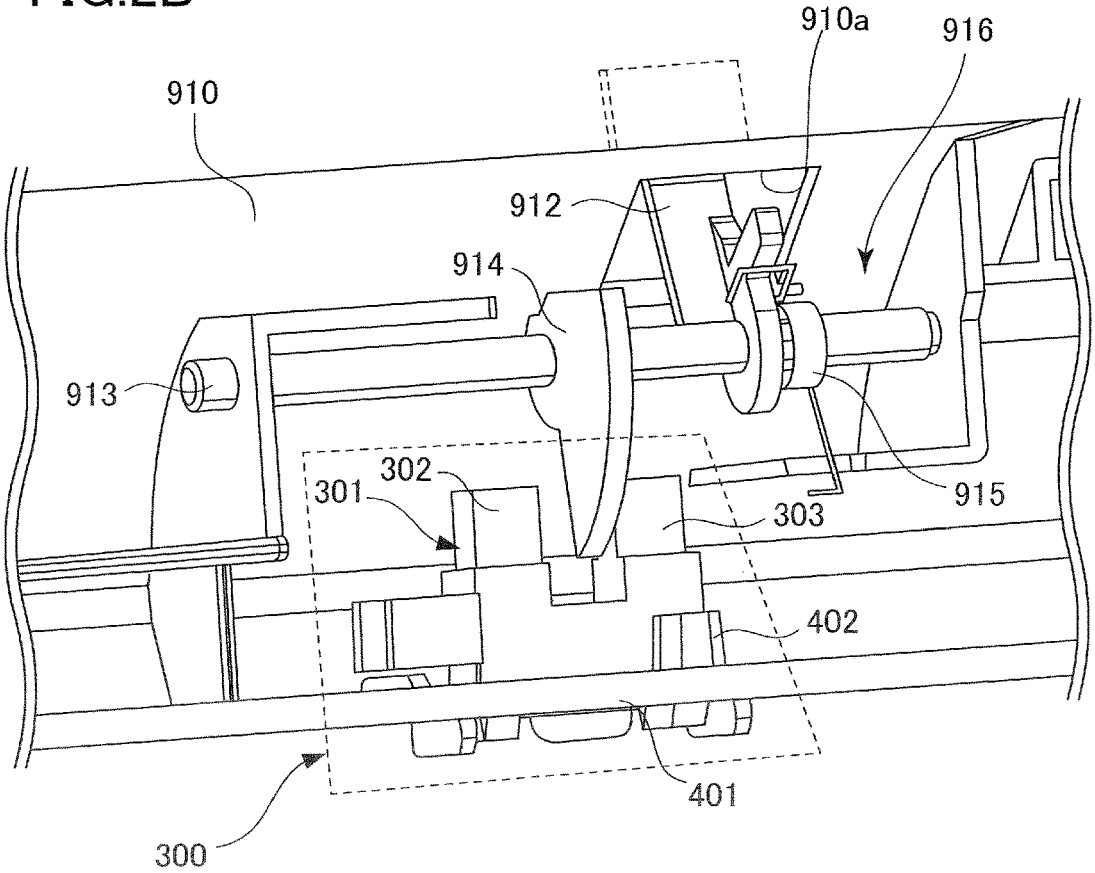
FIG. 2B is a perspective view illustrating the sensor flag from a rear side.

FIG. 2A is a perspective view illustrating the conveyance guide 910, the registration roller 909 and a pressing portion 912. For better understanding, the opposing registration roller and other components are not shown in the drawing. FIG. 2B is a view illustrating a flag unit 916 from a rear side.

As illustrated in FIG. 2B, the conveyance guide 910 has an attaching portion 401 serving as a supporting portion of the present embodiment formed integrally thereto, and a photo-interruptor 301 is detachably attached to the attaching portion 401. The photo-interruptor 301 includes a light emitting component 302 having a light emitting element arranged on an inner side thereof, and a photosensing portion 303 retaining a photosensing element on an inner side thereof.

Further, the flag unit 916 serving as a moving unit according to the present embodiment is attached to the conveyance guide 910. The flag unit 916 includes a pivot shaft 913 supported rotatably on the conveyance guide 910, and a pressing portion 912 and a flag portion 914 respectively integrally fixed to the pivot shaft 913. The pressing portion 912 is protruded through a long hole 910*a* formed on the conveyance guide 910 to a conveyance path CP formed of the conveyance guides 910 and 911 (refer to FIG. 1). The flag portion 914 is formed to enter between the light emitting component 302 and the photosensing portion 303 and block the light emitted from the light emitting component 302. The flag unit 916 is formed so that the pressing portion 912 is protruded to the conveyance path CP by a torsion spring 915 attached to the pivot shaft 913, and the flag portion 914 is urged to a pivot angle so as not to block the light emitted from the light emitting component 302. If there is no sheet in the conveyance path CP, the photo-interruptor 301 is in a photosensing state in which the light emitted from the light emitting component 302 is sensed by the photosensing portion 303.

Then, in a state where the pressing portion 912 is pressed by the sheet conveyed by the pickup roller 908 and passed through the conveyance path CP, the flag portion 914 pivots together with the pivot shaft 913 against the urging force of the torsion spring 915. Then, the light emitted from the light emitting component 302 to the photosensing portion 303 is blocked by the flag portion 914. That is, if a sheet is present in the conveyance path CP, the photo-interruptor 301 is in a blocked state where the light emitted from the light emitting component 302 to the photosensing portion 303 is blocked.

As described, it is detected that a leading edge of the sheet P has reached a position of the pressing portion 912 by the photo-interruptor 301 switching from a photosensing state to a blocked state, and a detection signal is output. Further, in a state where the trailing edge of the sheet P being conveyed passes through the pressing portion 912, the flag portion 914 pivots together with the pivot shaft 913 by the urging force of the torsion spring 915, and the photo-interruptor 301 is switched from the blocked state to the photosensing state. Thereby, it is detected that the trailing edge of the sheet P has passed the position of the pressing portion 912, and a detection signal is output. The pickup roller 908, the flag unit 916 and a photo-interruptor unit 300 described later constitutes a sheet conveyance apparatus that conveys sheets.

Detailed Configuration of Photo-Interruptor Unit

Figure 3A:
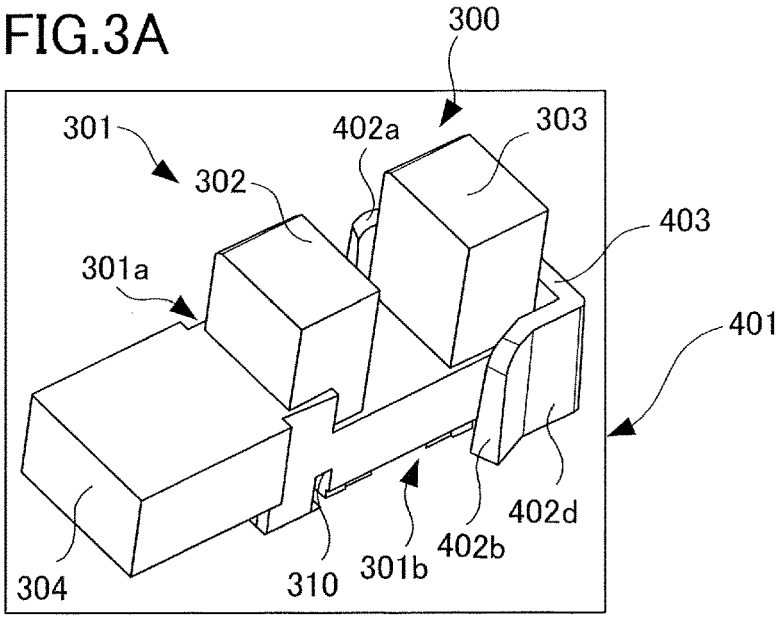
FIG. 3A is a view illustrating an attaching portion in a state where a photo-interruptor is attached.
Figure 3B:
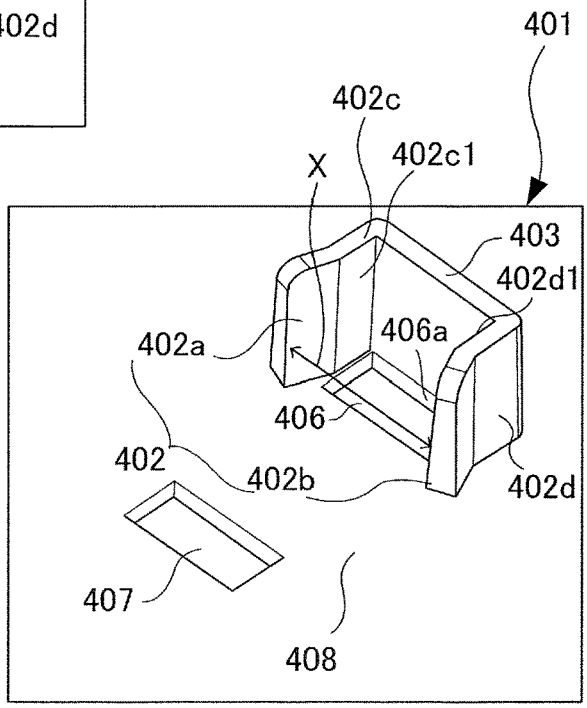
FIG. 3B is a perspective view illustrating an attaching portion in a state where the photo-interruptor is removed.
Figure 3C:
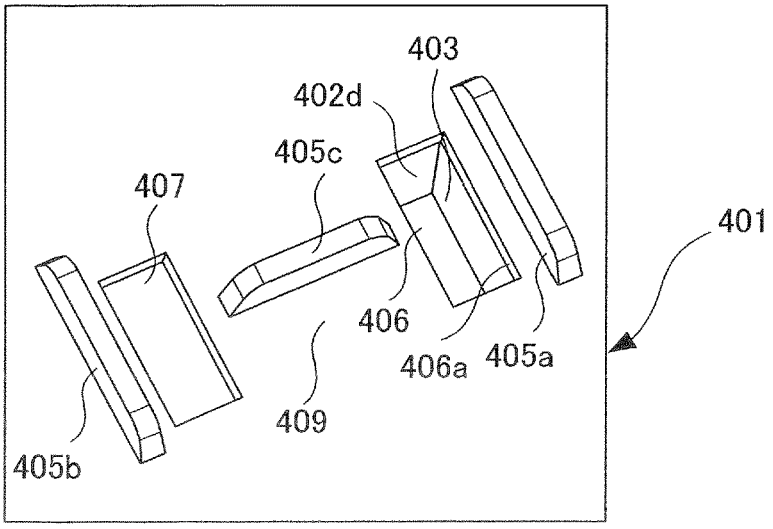
FIG. 3C is a perspective view illustrating the attaching portion from a rear side.

FIG. 3A is a perspective view illustrating the photo-interruptor unit 300 configured by attaching the photo-interruptor 301 to the attaching portion 401. FIG. 3B is a perspective view in which the attaching portion 401 to which the photo-interruptor 301 is attached is viewed from a side having an attaching surface 408. FIG. 3C is a perspective view illustrating the attaching portion 401 from a rear side 409. In FIGS. 3A to 3C, a portion of the attaching portion 401 is cut away in the drawing.

As illustrated in FIG. 3A, the photo-interruptor 301 includes a connector portion 304 that is electrically connected with the control unit 200 (refer to FIG. 1) through wiring, wherein the connector portion 304, the light emitting component 302 and the photosensing portion 303 are arranged in line along a longitudinal direction, that is, movement direction. A plurality of connector pins (not shown) are arranged on an inner side of the connector portion 304. An exterior of the photo-interruptor 301 composed of the connector portion 304, the light emitting component 302 and the photosensing portion 303, with a first hook portion 306 and a second hook portion 307 described later, is formed by a resin having elasticity, such as polycarbonate. The second hook portion is arranged closer to the connector portion than the first hook portion in the movement direction and configured to deform elastically in the deformation direction.

As illustrated in FIG. 3B, the attaching portion 401 includes the attaching surface 408 to which the photo-interruptor 301 is attached. The attaching surface 408 includes a first engagement hole 406, also referred to as hole or first hole, and a second engagement hole 407, also referred to as second hole, which are aligned in the longitudinal direction. A first guide rib 402, also referred to as guide portion or first guide portion, and a regulation rib 403 are protruded from the attaching surface 408 in a direction perpendicular to the attaching surface 408. The first guide rib 402 includes a pair of guide ribs 402*a*, 402*b* serving as first rib portion and second rib portion, and the guide ribs 402*a* and 402*b* are arranged in a short length direction, that is, deformation direction shown by arrow X of FIG. 3B, which is orthogonal to the longitudinal direction, with a distance therebetween. Further, the guide ribs 402*a* and 402*b* are designed so that the distance therebetween in the short length direction is narrowed as it approaches the regulation rib 403 in the longitudinal direction. That is, the distance between the first rib portion and the second rib portion in the deformation direction is configured to be narrowed toward a downstream direction of the movement direction. Further, the first guide rib 402 includes guide ribs 402*c* and 402*d*. In a state where the distance therebetween in the short length direction is narrowed for a predetermined amount, the guide ribs 402*a* and 402*b* are respectively connected to the guide ribs 402*c* and 402*d*.

The guide ribs 402*c* and 402*d* are arranged parallel with respect to the longitudinal direction with a distance therebetween in the short length direction, at a position downstream of the guide ribs 402*a* and 402*b* and upstream of the regulation rib 403 in the movement direction. By having the photo-interruptor 301 inserted between the guide ribs 402*a* and 402*b*, the first hook portion 306 described later is deformed in the deformation direction. By moving the photo-interruptor 301 toward the regulation rib 403, the first hook portion 306 is further deformed by the guide ribs 402*a* and 402*b* into a shape capable of being engaged with an edge of the first engagement hole 406. The regulation rib 403 serving as a regulating portion according to the present embodiment extends in a short length direction so as to be connected to a first end portion of the pair of guide ribs 402*c* and 402*d*, and a first end thereof is connected continuously to an engagement wall 406*a* of an engagement hole 406. Thereby, if the regulation rib 403 and the photo-interruptor 301 are abutted against one another, the position of the photo-interruptor 301 in the movement direction is regulated to a position where the first hook portion 306 is overlapped with the engagement hole 406. By inserting the first hook portion 306 to the first engagement hole 406 in a state where the photo-interruptor 301 is regulated by the regulation rib 403, the first hook portion 306 is engaged with the edge of the first engagement hole 406. As described, the photo-interruptor 301 is attached to the attaching portion 401.

In a state where the photo-interruptor 301 is attached to the attaching portion 401, the guide ribs 402*a*, 402*b*, 402*c* and 402*d* are opposed to side surfaces 301*a* and 301*b* of the photo-interruptor 301. In this state, the gap formed between a pair of guide ribs 402*a* and 402*b* with the side surfaces 301*a* and 301*b* opposed thereto is narrowed toward the regulation rib 403 in the longitudinal direction. Further, the guide ribs 402*c* and 402*d* serving as the position regulating portion according to the present embodiment are respectively formed with a slight gap formed between the side surfaces 301*a* and 301*b*. Side surfaces 402*c*1 and 402*d*1 of the guide ribs 402*c* and 402*d* are opposed to the side surfaces 301*a* and 301*b* at a distance of a same length as the gap between the guide ribs 402*a* and 402*b* and the side surfaces 301*a* and 301*b* most downstream in the movement direction. The side surfaces 402*c*1 and 402*d*1, i.e., position regulating surfaces, are opposed to the photo-interruptor 301 and regulates the position of the photo-interruptor 301 in the short length direction.

As illustrated in FIG. 3C, rear side ribs 405*a*, 405*b* and 405*c* serving as opposite surface-side ribs are protruded perpendicularly with respect to the rear side 409 from the rear side 409 which is a side opposite to the attaching surface 408 of the attaching portion 401. The first engagement hole 406 and the second engagement hole 407 are formed to pass through from the attaching surface 408 to the rear side 409 between the rear side ribs 405*a* and 405*b*. Further, the rear side rib 405*c* is provided at a position between the first engagement hole 406 and the second engagement hole 407, and it is arranged orthogonally with respect to the rear side ribs 405*a* and 405*b*.

Figure 4A:
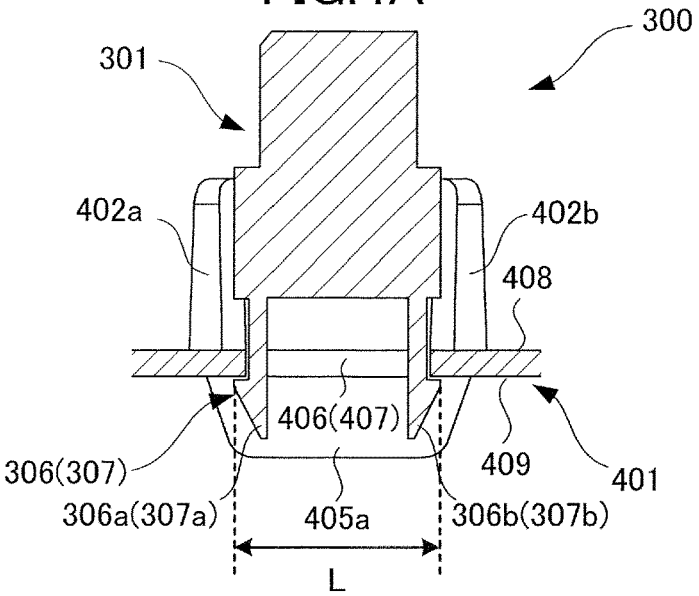
FIG. 4A is a cross-sectional view of the photo-interruptor unit.
Figure 4B:
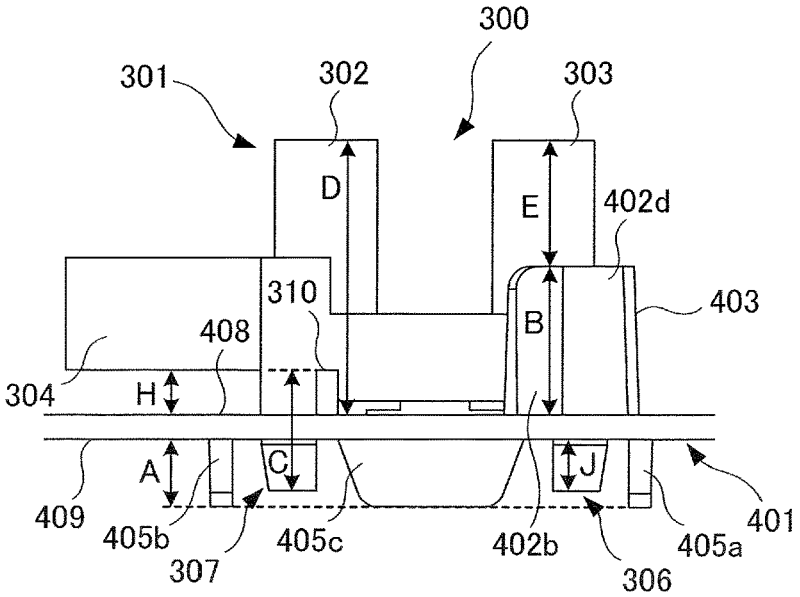
FIG. 4B is a side view of the photo-interruptor unit.
Figure 4C:
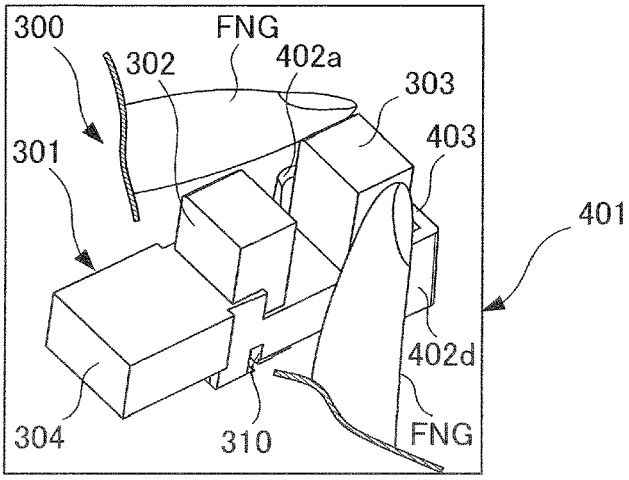
FIG. 4C is an explanatory view of an attachment process of the photo-interruptor unit by an operator.

FIG. 4A is a cross-sectional view illustrating a state in which the photo-interruptor 301 is attached to the attaching portion 401. FIG. 4B is a side view illustrating a state in which the photo-interruptor 301 is attached to the attaching portion 401. FIG. 4C is a perspective view illustrating a step in which the operator attaches the photo-interruptor 301. As illustrated in FIGS. 4A and 4B, the photo-interruptor 301 includes the first hook portion 306 and the second hook portion 307 which are respectively engageable with the first engagement hole 406 and the second engagement hole 407. The first hook portion 306 and the second hook portion 307 have hook shapes formed at the leading edges thereof. By inserting the first hook portion 306 and the second hook portion 307 to the first engagement hole 406 and the second engagement hole 407, the hook shapes of the first hook portion 306 and the second hook portion 307 are respectively engaged with the edges of the first engagement hole 406 and the second engagement hole 407. As described, the photo-interruptor 301 is attached to the attaching portion 401. The first hook portion 306, the second hook portion 307, the first engagement hole 406 and the second engagement hole 407 adopt a so-called snap-fitting configuration. The first hook portion 306 and the second hook portion 307 are formed to have a same shape.

The first hook portion 306 includes a pair of hooks 306*a* and 306*b* that are arranged in parallel in the deformation direction. The pair of hooks 306*a* and 306*b* are formed of resin so that it is elastically deformable in the deformation direction of the first hook portion 306, that is, in right and left directions of FIG. 4A. The pair of hooks 306*a* and 306*b* in a non-elastically deformed state is arranged at a position interposed between the guide ribs 402*a* and 402*b*. That is, a distance X between upstream ends of the guide ribs 402*a* and 402*b* in the movement direction of the photo-interruptor 301 is greater than the distance between the pair of hooks 306*a* and 306*b* in a non-elastically deformed state. That is, the distance in the deformation direction between the upstream end of the first rib portion in the movement direction and the upstream end of the second rib portion in the movement direction is greater than the distance between the pair of hooks that are not in an elastically deformed state at a most distant position in the deformation direction. The second hook portion 307 includes a pair of hooks 307*a* and 307*b*, and the pair of hooks 307*a* and 307*b* is formed of resin so that they are elastically deformable in the deformation direction. The pair of hooks 306*a* and 306*b* and the pair of hooks 307*a* and 307*b* include tapered portions formed on outer sides thereof in the short length direction.

When attaching the photo-interruptor 301 to the attaching portion 401, the tapered portions of the pair of hooks 306*a* and 306*b* and the pair of hooks 307*a* and 307*b* contact the attaching portion 401. When the tapered portions of the pair of hooks 306*a* and 306*b* and the pair of hooks 307*a* and 307*b* abut against the attaching portion 401, the hooks 306*a* and 306*b* and the hooks 307*a* and 307*b* are bent inward in the short length direction of the photo-interruptor 301. That is, in a state where the photo-interruptor 301 is attached to the attaching portion 401, the deformation direction of the first hook portion 306 and the second hook portion 307 is the short length direction of the photo-interruptor 301. Thereafter, the pair of hooks 306*a* and 306*b* and the pair of hooks 307*a* and 307*b* are further inserted until the hook shapes formed on the leading edges of the pair of hooks 306*a* and 306*b* and the pair of hooks 307*a* and 307*b* are inserted to the first engagement hole 406 and the second engagement hole 407. Thereby, the pair of hooks 306*a* and 306*b* and the pair of hooks 307*a* and 307*b* are restored to their original shapes and are engaged with the edges of the first engagement hole 406 and the second engagement hole 407, as illustrated in FIGS. 4A to 4C, by which the photo-interruptor 301 is attached to the attaching portion 401. The state in which the pair of hooks 306*a* and 306*b* and the pair of hooks 307*a* and 307*b* are engaged to the edges of the first engagement hole 406 and the second engagement hole 407 can be referred to as an engaged state, and a state in which the pair of hooks 306*a* and 306*b* and the pair of hooks 307*a* and 307*b* are elastically deformed toward the inner side by the guide ribs 402*a* and 402*b* can be referred to as an inserted state. Then, the direction of deformation between the engaged state and the inserted state of the pair of hooks 306*a* and 306*b* and the pair of hooks 307*a* and 307*b* is set as the deformation direction. Further, in the above-described inserted state, each of the pair of hooks 306*a* and 306*b* and the pair of hooks 307*a* and 307*b* are positioned so that the leading edges thereof formed in a tapered shape are overlapped with the first engagement hole 406 and the second engagement hole 407.

As illustrated in FIG. 4B, a height B of the pair of guide ribs 402*a*, 402*b* from the attaching surface 408 is formed to be higher than a height H from the attaching surface 408 to a base end portion 310 of the first hook portion 306 and the second hook portion 307. Further, the height B is formed to be lower by a predetermined amount E than a height D from the attaching surface 408 to an apex portion of the light emitting component 302 and the photosensing portion 303. Further, the guide ribs 402*c* and 402*d* and the regulation rib 403 are formed to have the same height as height B. Thereby, as illustrated in FIG. 4C, if an operator attaches the photo-interruptor 301 by pinching the photosensing portion 303 with his/her fingers FNG, the fingers FNG will not bump against the guide ribs 402*a*, 402*b*, 402*c* and 402*d* and the regulation rib 403. In the present embodiment, the predetermined amount E is set to 5 mm, but the length of the predetermined amount E is not limited to this length. For example, if the predetermined amount E is greater than 5 mm, the light emitting component 302 can be easily pinched by fingers FNG but it becomes difficult to insert the hooks 306*a* and 306*b* between the pair of guide ribs 402*a* and 402*b*. Therefore, a value determined by taking into consideration the attachability of the photo-interruptor 301 to the attaching surface 408 by the operator should be used as the predetermined amount E.

In a state where the photo-interruptor 301 is attached to the attaching portion 401, as illustrated in FIG. 4A, if external force is applied to the photo-interruptor 301 attached to the attaching portion 401, the photo-interruptor 301 attempts to rotate in a direction parallel to the short length direction. In the present embodiment, as described above, a minute gap, which is approximately 0.2 mm, is respectively formed between the side surfaces 301*a* and 301*b* of the photo-interruptor 301 and the pair of guide ribs 402*c* and 402*d*.

After the photo-interruptor 301 has been attached to the attaching portion 401, for example, it is assumed that external force is applied to the photo-interruptor 301 from the direction of the side surface 301*b*. In this state, the gap between the side surface 301*b* and the guide rib 402*d* is widened by the external force, while on the other hand, the side surface 301*a* abuts against the side surface 402*c*1 of the guide rib 402*c*, regulating the movement of the photo-interruptor 301 to the short length direction. In other words, the pair of guide ribs 402*c* and 402*d* regulates the position of the photo-interruptor 301 in the short length direction. Thereby, even if external force is applied unintentionally to the photo-interruptor 301, it becomes possible to prevent the engaged state between the first hook portion 306 and the first engagement hole 406 from being cancelled and causing engagement failure. The short length direction refers to a direction intersecting the insertion direction of the first hook portion 306 and the second hook portion 307 of the photo-interruptor 301.

Attachment of Photo-Interruptor Unit

Figure 5C:
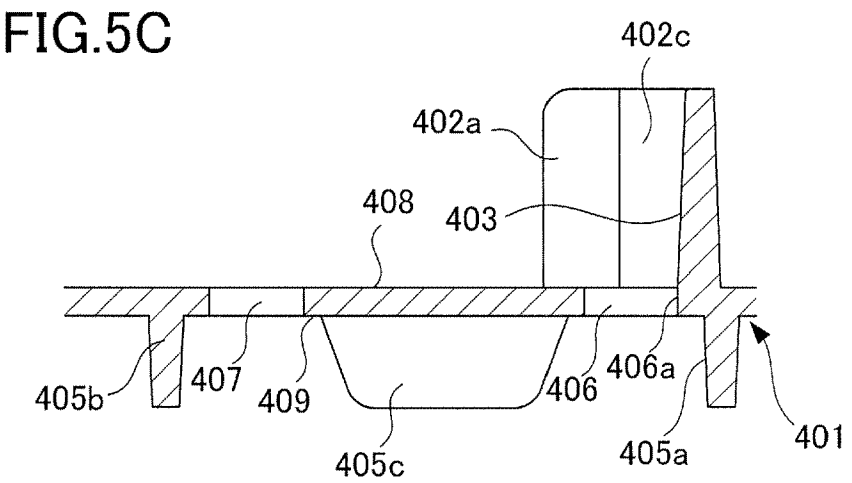
FIG. 5C is a cross-sectional view of an attaching portion.
Figure 5D:
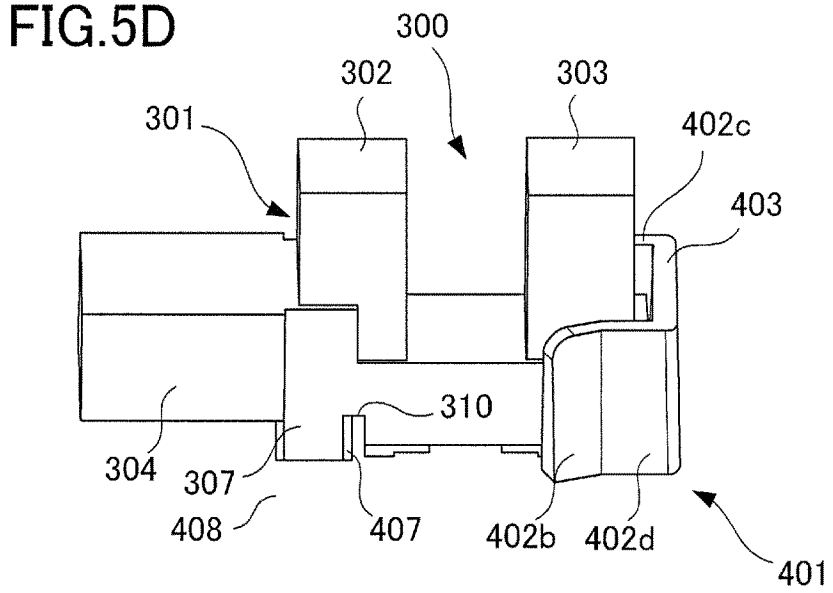
FIG. 5D is a perspective view illustrating a state where the photo-interruptor is attached.
Figure 5A:
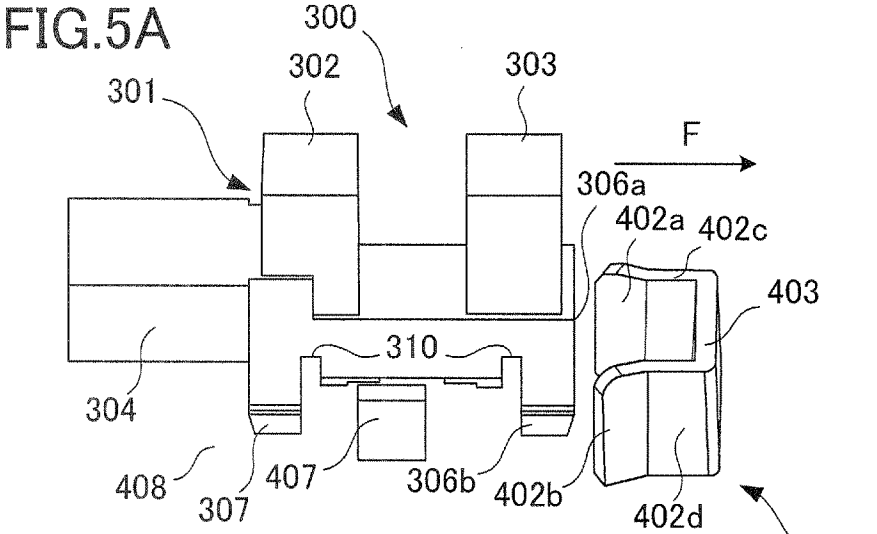
FIG. 5A is a perspective view illustrating a method for inserting the photo-interruptor to the attaching portion.
Figure 5B:
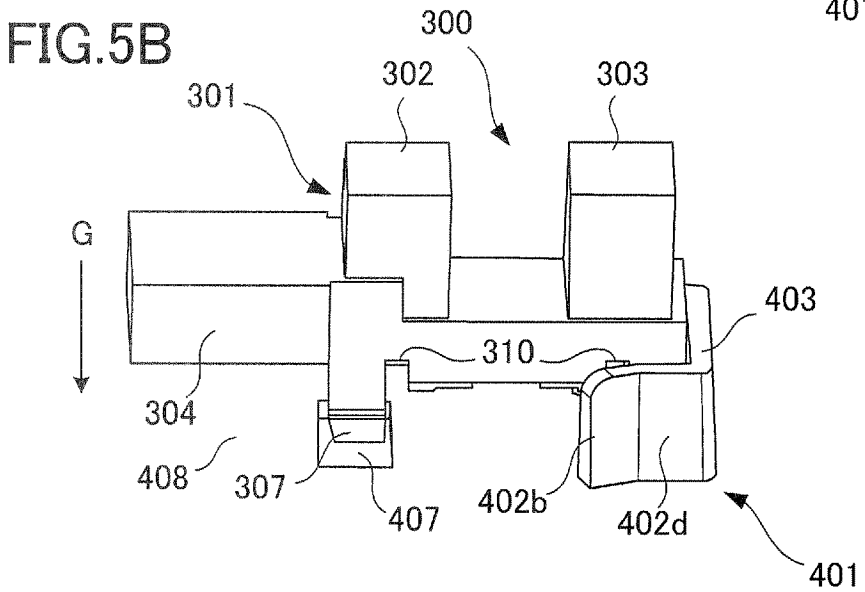
FIG. 5B is a perspective view illustrating a method for engaging the photo-interruptor to the attaching portion.

Next, a method for attaching the photo-interruptor 301 according to the present embodiment to the attaching portion 401 will be described. FIG. 5A is a view illustrating a method in which the photo-interruptor 301 is moved toward the attaching portion 401, and FIG. 5B is a view illustrating a method of engaging the photo-interruptor 301 to the attaching portion 401. Further, FIG. 5C is a cross-sectional view of the attaching portion 401, and FIG. 5D is a perspective view illustrating a state in which the photo-interruptor 301 is attached to the attaching portion 401. In a first step of the attachment process, the operator moves the photo-interruptor 301 in a movement direction (arrow F of FIG. 5A), which is a direction toward the regulation rib 403 from a pair of guide ribs 402*a* and 402*b* and parallel to the attaching surface 408. In the first step, the pair of hooks 306*a* and 306*b* of the first hook portion 306 is respectively abutted against the guide ribs 402*a* and 402*b* and is deformed inwardly in a short length direction of the photo-interruptor 301 along with the movement of the photo-interruptor 301. Then, the photo-interruptor 301 moves further and abuts against the regulation rib 403, by which the first step is completed.

Next, as a second step of the attachment process, the operator moves the photo-interruptor 301 in a state abutted against the regulation rib 403 by the first step to the insertion direction (arrow G of FIG. 5B), that is, toward the first engagement hole 406. As illustrated in FIG. 5C, the regulation rib 403 is formed as a continuous surface to the engagement wall 406*a* of the first engagement hole 406. Further, the first hook portion 306 (refer to FIG. 4A) is provided most downstream in the movement direction of the photo-interruptor 301. By moving the photo-interruptor 301 in a state abutted against the regulation rib 403 in the insertion direction, the first hook portion 306 is inserted to the first engagement hole 406, and the pair of hooks 306*a* and 306*b* are engaged with the edge of the first engagement hole 406.

According to the present embodiment, the first hook portion 306 is provided most downstream in the movement direction of the photo-interruptor 301, but the positional relationship between the regulation rib 403 and the engagement wall is not limited to that described above, depending on the position of the first hook portion of the photo-interruptor. For example, the positional relationship between the regulation rib 403 and the engagement wall should satisfy a position where the first hook portion is insertable to the first engagement hole in a state where the photo-interruptor 301 is abutted against the regulation rib 403. According further to the present embodiment, the attaching portion 401 is formed so that the second hook portion 307 is inserted to the second engagement hole 407 in a state where the pair of hooks 306*a* and 306*b* is inserted to the first engagement hole 406. Accordingly, the operator performs, as the attachment process, a first step of moving the photo-interruptor 301 to the movement direction until it abuts against the regulation rib 403, and a second step in which the photo-interruptor 301 in a state abutted to the regulation rib 403 is moved to the insertion direction. By performing the first step and the second step, as illustrated in FIG. 5D, the photo-interruptor 301 is attached to the attaching portion 401, and attachment of the photo-interruptor 301 is completed.

Prevention of Attachment to Rear Surface

Figure 6A:
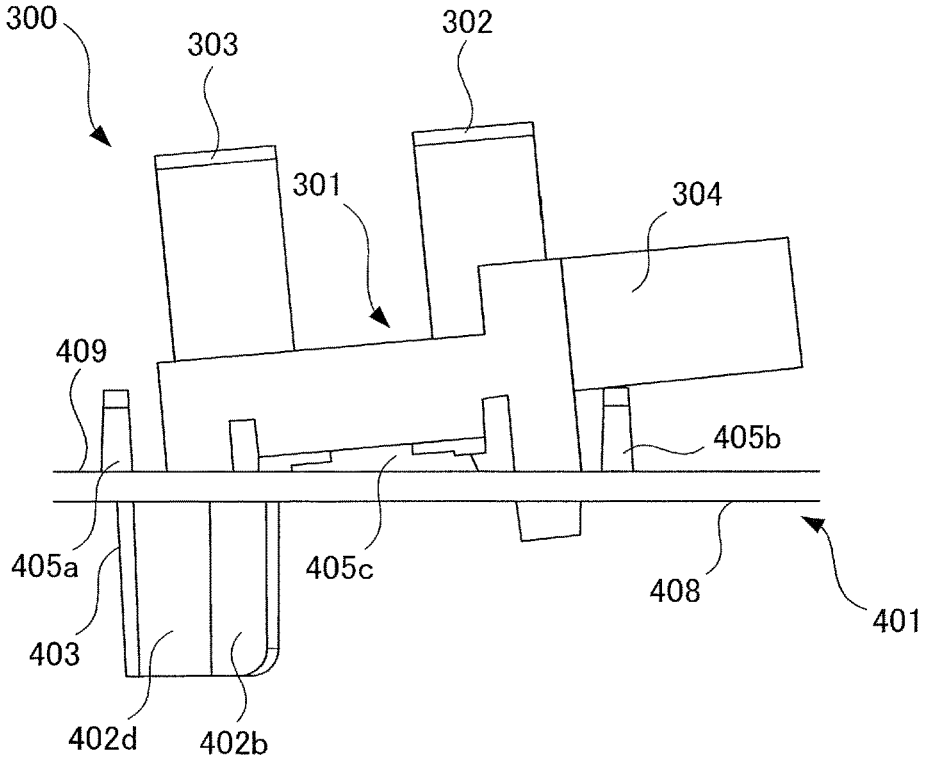
FIG. 6A is a cross-sectional view illustrating an example in which the photo-interruptor is attached from a rear side.
Figure 6B:
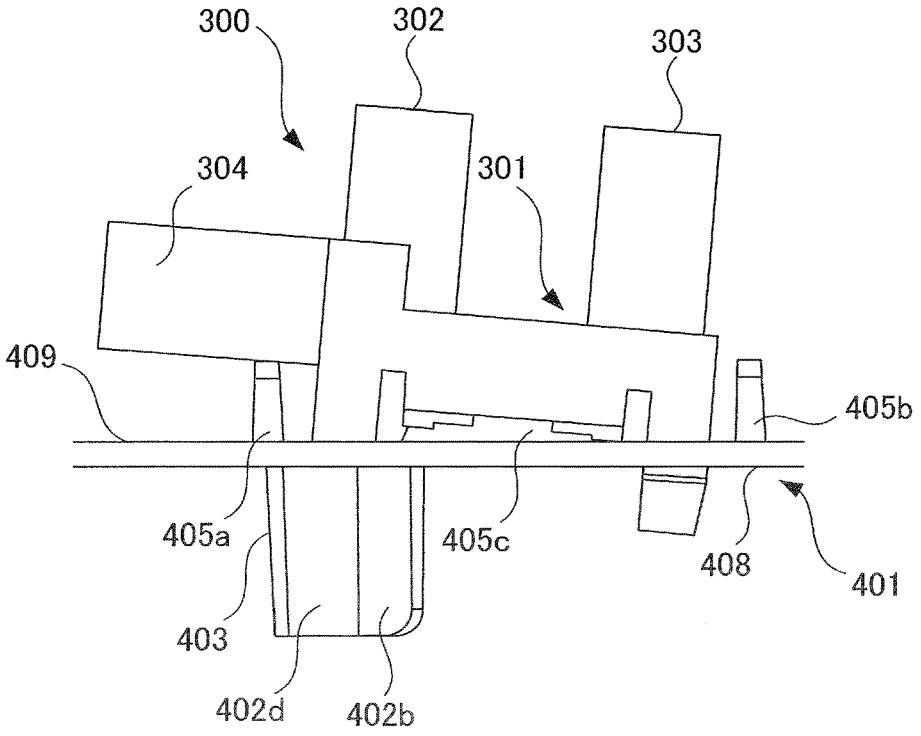
FIG. 6B is a cross-sectional view illustrating another example of a state where the photo-interruptor is attached from a rear side.

FIG. 6A is a cross-sectional view illustrating a state where the photo-interruptor 301 is attached from the rear side 409 of the attaching portion 401. FIG. 6B is a cross-sectional view illustrating a state where the photo-interruptor 301 is attached in a state reversed from the state shown in FIG. 6A.

The length of the rear side ribs 405*a* and 405*b* (refer to FIG. 3C) is set longer than a length L (refer to FIG. 4A) of the photo-interruptor 301 in the short length direction. The rear side rib 405*c* is a rib directed in the direction orthogonal to the rear side ribs 405*a* and 405*b* and arranged between the rear side ribs 405*a* and 405*b* (refer to FIG. 3C). As illustrated in FIG. 4B, the height A of the rear side ribs 405*a*, 405*b* and 405*c* is even greater than the greater one of the height H from the attaching surface 408 to the connector portion 304 or a length J from the rear side 409 to the leading edges of the first hook portion 306 and the second hook portion 307.

Therefore, as illustrated in FIG. 6A, if an operator attempts to attach the photo-interruptor 301 from the rear side 409, the connector portion 304 abuts (interferes) against the rear side rib 405*b*, and thereby, attachment of the photo-interruptor 301 to the rear side 409 is prevented. That is, the rear side ribs 405*a* and 405*b* interfere with the photo-interruptor 301 before the photo-interruptor 301 is attached to the attaching portion 401 from the rear side 409. Further, as illustrated in FIG. 6B, if the operator attempts to attach the photo-interruptor 301 in a state rotated for 180 degrees from the rear side 409, the connector portion 304 abuts against the rear side rib 405*a*, and thereby, attachment of the photo-interruptor 301 to the rear side 409 is prevented. Even if the photo-interruptor 301 is forced into the attaching portion 401 in a state where the connector portion 304 is abutted against the rear side ribs 405*a* and 405*b*, the photo-interruptor 301 will not be attached since the length of the rear side ribs 405*a* and 405*b* is long as described above.

Fall Prevention and Removal

Figure 7A:
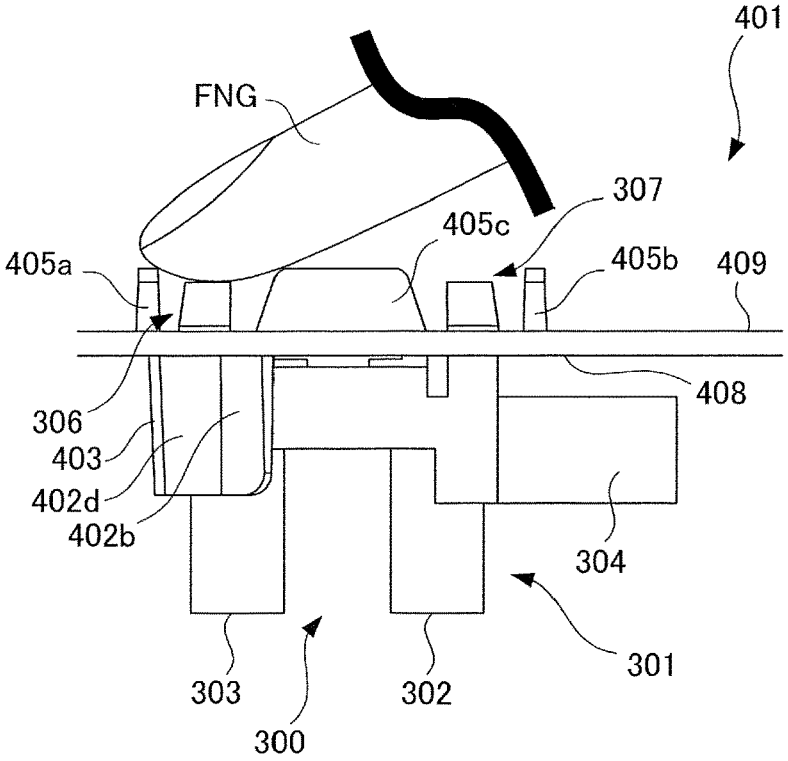
FIG. 7A is a cross-sectional view illustrating a state where an operator has contacted a hook portion from a rear side.
Figure 7B:
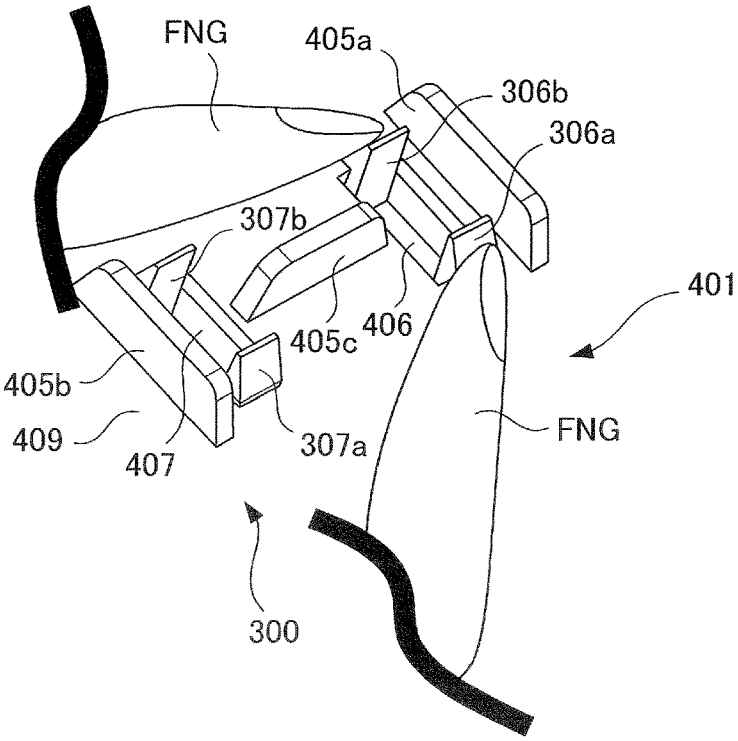
FIG. 7B is an explanatory view of a detachment process of the photo-interruptor by an operator.

FIG. 7A is a cross-sectional view illustrating a state where the operator has contacted the first hook portion 306 from the rear side 409 after the photo-interruptor 301 has been attached to the attaching portion 401, and FIG. 7B is an explanatory view of a removal process of the photo-interruptor 301 by the operator. The operator may erroneously contact the first hook portion 306 and the second hook portion 307 from the rear side 409 after the photo-interruptor 301 has been attached to the attaching portion 401. For example, as illustrated in FIG. 7A, in a state where the fingers FNG attempt to push the first hook portion 306 or the second hook portion 307 from the rear side 409, the rear side ribs 405*a* and 405*c* or the rear side ribs 405*b* and 405*c* abut against the fingers FNG Thereby, pressing force from the fingers FNG applied to the first hook portion 306 or the second hook portion 307 is relieved by the rear side ribs 405*a*, 405*b* and 405*c*, and thereby, the falling of the photo-interruptor 301 from the rear side 409 is prevented.

Meanwhile, when it is necessary to remove the photo-interruptor 301, such as during periodic maintenance of the apparatus body, as illustrated in FIG. 7B, the operator can pinch the first hook portion 306 or the second hook portion 307 using his/her fingers FNG Thereby, the first hook portion 306 or the second hook portion 307 will deform inwardly toward the short length direction of the photo-interruptor 301, and the photo-interruptor 301 can be removed from the first engagement hole 406 and the second engagement hole 407.

As described above, according to the present embodiment, by providing the guide rib 402 to the attaching surface 408 of the photo-interruptor 301, the first hook portion 306 can be moved easily to a certain direction while maintaining contact with the guide rib 402. Further, the regulation rib 403 is provided to regulate movement of the photo-interruptor 301 at a position where the first hook portion 306 can be attached to the attaching portion 401, the photo-interruptor 301 can be attached easily. Further, the guide rib 402 has a longer width than the length of the first hook portion 306 in the short length direction, and it is designed to be narrowed toward the regulation rib 403. Thereby, it becomes possible to prevent the occurrence of a state where the first hook portion 306 is damaged by abutting the first hook portion 306 against the guide rib, and the assembling process of the photo-interruptor 301 is facilitated.

The "movement direction" according to the present embodiment refers to a movement direction by design in a state where an operator, or a robot, moves the photo-interruptor 301 in the first step. Even if the actual direction in which the operator moves the photo-interruptor 301 is deviated from the movement direction, the assembling operation can be performed without any problem if the deviated direction is within a permissible range.

The movement direction according to the present embodiment is a direction parallel to the attaching surface 408, and it is described as a direction corresponding to the longitudinal direction of the photo-interruptor 301 in the state after assembly. However, the deformation direction of the hook portion provided on the photo-interruptor and a direction obliquely intersecting the insertion direction of the hook portion to the hole provided on the attaching surface can be set as the movement direction. Even according to this case, an effect similar to the present embodiment can be achieved by providing a guide portion that guides the hook portion to be deformed in the deformation direction and a regulating portion that regulates the position of the photo-interruptor in the movement direction.

Second Embodiment

With respect to the first embodiment, the present embodiment further provides a second guide rib 410 that guides the hook portion 307 on both ends of the second engagement hole 407. Further, the second guide rib 410 is formed integrally with each of the guide ribs 402*a* and 402*b*. In the description of the present embodiment, only the portions that differ from the first embodiment will be described.

Detailed Configuration of Phot-Interruptor Unit

Figure 8A:
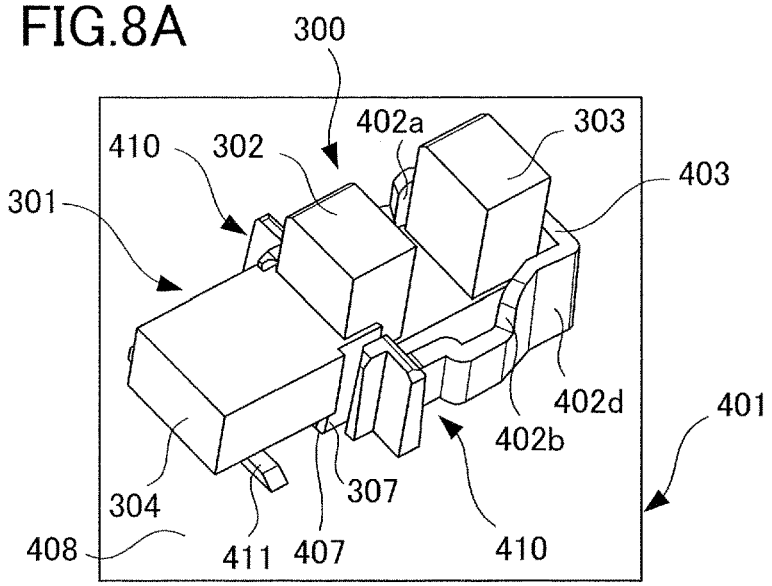
FIG. 8A is a view illustrating an attaching portion according to a second embodiment in a state where a photo-interruptor is attached.
Figure 8B:
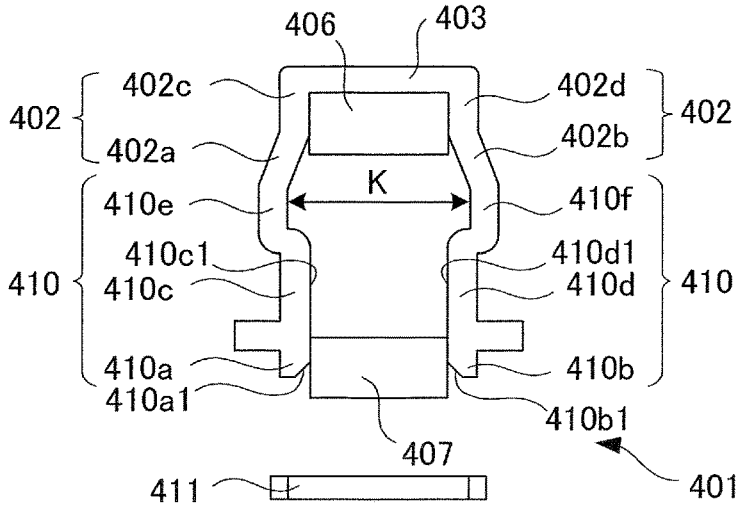
FIG. 8B is an upper view illustrating a state where the photo-interruptor is detached.
Figure 8C:
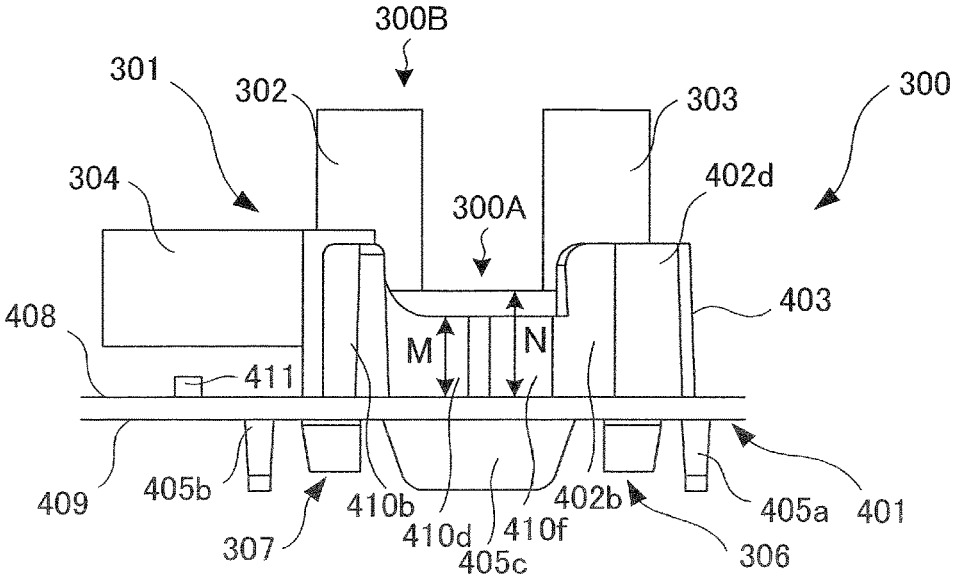
FIG. 8C is an upper view illustrating a state where the photo-interruptor is detached.

FIG. 8A is a perspective view illustrating the photo-interruptor unit 300 that is configured by attaching the photo-interruptor 301 to the attaching portion 401 according to the present embodiment. FIG. 8B is a top view of the attaching portion 401 in which the photo-interruptor 301 is not shown, and FIG. 8C is a side view of a state in which the photo-interruptor 301 is attached to the attaching portion 401. The attaching portion 401 according to the present embodiment includes the second guide rib 401 and a pillow rib (supporting rib) 411 in addition to the first guide rib 402 and the regulation rib 403. The second guide rib 410, i.e., second guide portion, includes guide ribs 410*a* and 410*b* that guide the hook portion 307, guide ribs 410*c* and 410*d* that are provided in parallel and opposed to each other, and guide ribs 410*e* and 410*f* that are positioned at a distance that is wider in opposing distance than the guide ribs 410*c* and 410*d*. The distance in the short length direction between guide ribs 410*a* and 410*b*, i.e., third rib portion and fourth rib portion, is set to be narrower as it approaches the regulation rib 403 in the longitudinal direction. In an area where the distance in the short length direction has been narrowed to a predetermined distance, the guide ribs 410*a* and 410*b* are respectively connected to the guide ribs 410*c* and 410*d*. The guide ribs 410*c* and 410*d* are arranged in parallel in the longitudinal direction and arranged with a gap formed in the short length direction. Side surfaces 410*c*1 and 410*d*1 of the guide ribs 410*c* and 410*d* are opposed to the side surfaces 301*a* and 301*b* with a slight gap formed therebetween in a state where the photo-interruptor 301 is attached to the attaching portion 401.

Further, as illustrated in FIG. 8B, an opposing distance K between the guide ribs 410*e* and 410*f* is set wider than the distance between the hook portions 306 and 307 of the photo-interruptor 301, that is, wider than length L of the photo-interruptor 301 in the short length direction (refer to FIG. 4A). Therefore, by moving the photo-interruptor 301 in the movement direction after inserting the pair of hooks 306*a* and 306*b* between the guide ribs 410*e* and 410*f*, the pair of hooks 306*a* and 306*b* will respectively abut against the guide ribs 402*a* and 402*b*. If the photo-interruptor 301 is moved even further toward the movement direction, the pair of hooks 306*a* and 306*b* are bent inwardly in the short length direction of the photo-interruptor 301 to a shape capable of being engaged with the edge of the first engagement hole 406. The first hook portion 306 will be inserted in the bent state to the first engagement hole 406, by which the pair of hooks 306*a* and 306*b* are engaged with the edge of the first engagement hole 406. Further, when attaching the second hook portion 307, by inserting the second hook portion 307 between the guide ribs 410*a* and 410*b*, side surfaces 410*a*1 and 410*b*1 of the guide ribs 410*a* and 410*b* will respectively abut against the pair of hooks 307*a* and 307*b* of the hook portion 307. Thereafter, by moving the photo-interruptor 301 toward the regulation rib 403, the second hook portion 307 will be deformed in the deformation direction by guide ribs 412*a* and 412*b* to a shape capable of being engaged with the edge of the second engagement hole 407. The second hook portion 307 will be inserted in the bent state to the second engagement hole 407, by which the pair of hooks 307*a* and 307*b* are engaged with the edge of the second engagement hole 407.

A pillow rib 411 is arranged at a position below the connector portion 304 in a state where the photo-interruptor 301 is attached to the attaching portion 401. The pillow rib 411 prevents the connector portion 304 from being deformed and causing the photo-interruptor 301 to fall when eternal force is applied to the connector portion 304 from above. As illustrated in FIG. 8C, a height M from the attaching surface 408 to a portion of the guide ribs 410*c* and 410*d* and the guide ribs 410*e* and 410*f* is lower than a height N from the attaching surface 408 to a recessed portion 300A of the light emitting component 302 and the photosensing portion 303. Thereby, it becomes possible to prevent the flag portion 914 (refer to FIG. 2B) from being interfered when passing between the light emitting component 302 and the photosensing portion 303.

Attachment of Photo-Interruptor Unit

Figure 9A:
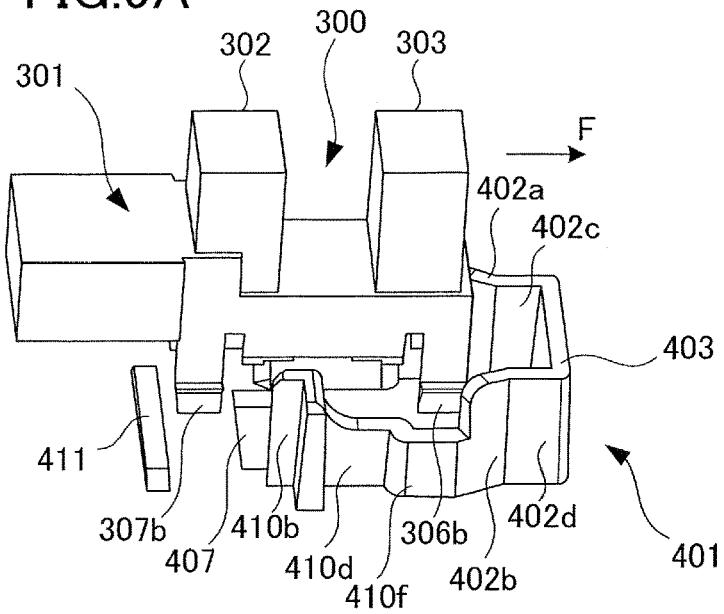
FIG. 9A is a perspective view illustrating a method of inserting the photo-interruptor according to the second embodiment to an attaching portion.
Figure 9B:
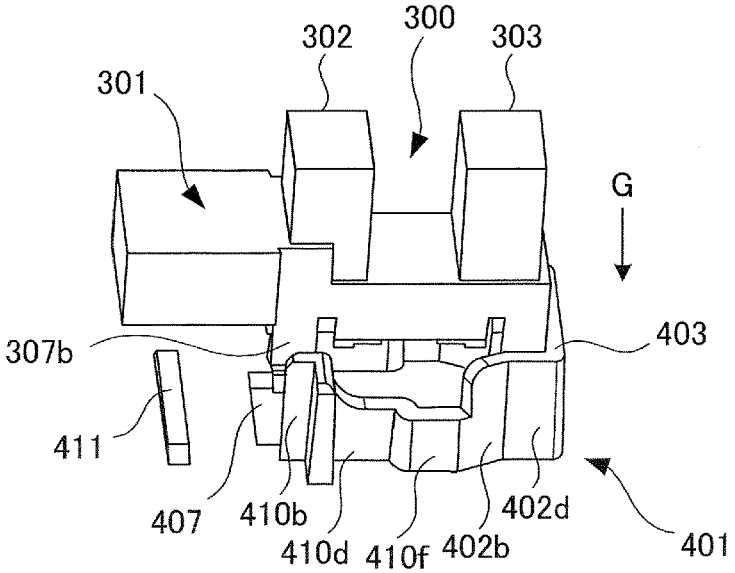
FIG. 9B is a perspective view illustrating a method for engaging the photo-interruptor to the attaching portion.
Figure 9C:
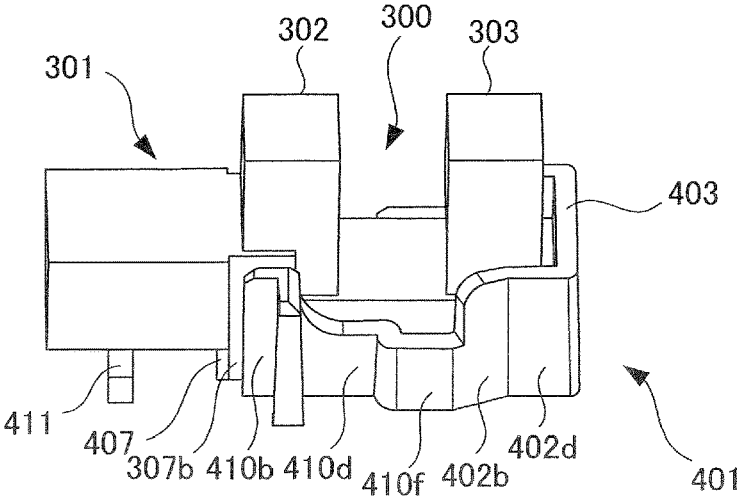
FIG. 9C is a view illustrating a state where the photo-interruptor is attached.

Next, a method for attaching the photo-interruptor 301 according to the present embodiment to the attaching portion 401 will be described. FIG. 9A is a view illustrating a method of moving the photo-interruptor 301 toward the attaching portion 401, and FIG. 9B is a view illustrating a method of engaging the photo-interruptor 301 to the attaching portion 401. FIG. 9C is a perspective view illustrating a state where the photo-interruptor 301 is attached to the attaching portion 401. In the first step of the attachment process, the operator moves the photo-interruptor 301 in the movement direction, i.e., arrow F of FIG. 9A, set to a direction moving from a pair of guide ribs 402*a* and 402*b* toward the regulation rib 403 and parallel to the attaching surface 408. At this time, by moving the photo-interruptor 301 in the movement direction after inserting the first hook portion 306 between the guide ribs 410*e* and 410*f*, the pair of hooks 306*a* and 306*b* can be easily abutted against the guide ribs 402*a* and 402*b*.

In the first step, the pair of hooks 306*a* and 306*b* of the first hook portion 306 respectively abut against the guide ribs 402*a* and 402*b*, and along with the movement of the photo-interruptor 301, deforms inwardly in the short length direction of the photo-interruptor 301. Further, along with the movement of the photo-interruptor 301, the second hook portion 307 will abut against the guide ribs 410*a* and 410*b*. Then, by moving the photo-interruptor 301 further toward the regulation rib 403, the second hook portion 307 will be deformed in the deformation direction by the guide ribs 412*a* and 412*b*. Then, the photo-interruptor 301 moves further and abuts against the regulation rib 403, by which the first step is completed.

Next, as a second step of the attachment process, the operator moves the photo-interruptor 301 in a state abutted against the regulation rib 403 in the first step toward the insertion direction, that is, toward the first engagement hole 406. The regulation rib 403 is formed as a continuous surface to the engagement wall 406*a* of the first engagement hole 406 (refer to FIG. 5C). Further, the first hook portion 306 is provided most downstream in the movement direction of the photo-interruptor 301. By moving the photo-interruptor 301 in a state abutted against the regulation rib 403 in the insertion direction, the first hook portion 306 is inserted to the first engagement hole 406, and the pair of hooks 306*a* and 306*b* are engaged with the edge of the first engagement hole 406. Further, along with the movement of the photo-interruptor 301 in the insertion direction, the second hook portion 307 in the deformed state will be inserted to the second engagement hole 407, and the pair of hooks 307*a* and 307*b* will be engaged with the edge of the second engagement hole 407.

According to the present embodiment, similar to the first embodiment, the first hook portion 306 is provided most downstream in the movement direction of the photo-interruptor 301. However, the positional relationship between the regulation rib 403 and the engagement wall is not limited to that described above, depending on the position of the first hook portion of the photo-interruptor. For example, the positional relationship between the regulation rib 403 and the engagement wall should satisfy a position where the first hook portion is insertable to the first engagement hole in a state where the photo-interruptor 301 is abutted against the regulation rib 403. Similarly, according to the present embodiment, the attaching portion 401 is formed so that the second hook portion 307 is inserted to the second engagement hole 407 in a state where the pair of hooks 306*a* and 306*b* is inserted to the first engagement hole 406. Accordingly, the operator performs, as the attachment process, a first step of moving the photo-interruptor 301 to the movement direction until it abuts against the regulation rib 403, and a second step in which the photo-interruptor 301 in a state abutted to the regulation rib 403 is moved to the insertion direction. By performing the first step and the second step, as illustrated in FIG. 9C, the photo-interruptor 301 is attached to the attaching portion 401, and attachment of the photo-interruptor 301 is completed.

As described, according to the present embodiment, the guide rib 402 and the second guide rib 410 are provided integrally to the attaching surface 408 of the photo-interruptor 301. Thereby, the first hook portion 306 and the second hook portion 307 can be moved easily to a certain direction in a state being respectively abutted against the guide ribs 402 and 410. Further, the regulation rib 403 is provided to restrict movement of the photo-interruptor 301 at a position where the first hook portion 306 and second hook portion are attachable to the attaching portion 401, and so the attachment of the photo-interruptor 301 is facilitated. Further, the guide rib 410 has a width longer than the length of the first hook portion 306 in the short length direction, and the width of the guide rib 410 is narrowed toward the regulation rib 403 to allow deformation of the first hook portion 306. Further, the guide rib 410 has a width longer than the length of the second hook portion 307 in the short length direction, and the width of the guide rib 410 is narrowed toward the regulation rib 403. According to such configuration, it becomes possible to suppress the occurrence of a state where the first hook portion 306 and the second hook portion 307 are damaged during abutment against the guide rib, and the assembling process of the photo-interruptor 301 is facilitated.

According to the first and second embodiments described above, a gap is formed between the side surfaces 301*a* and 301*b* and the pair of guide ribs 402*c* and 402*d* or the second guide ribs 410*c* and 410*d*, but the gap is not necessary.

Further, the application of the photo-interruptor unit 300 is not limited to sheet detection, and the photo-interruptor unit 300 can be applied to detecting movement of other components such as the opening and closing of a door member. Further, the photo-interruptor unit 300 is not limited to being provided in the apparatus body 900A, and it can be provided in the document conveyance apparatus 950A or other devices such as a finisher connected to the apparatus body and providing various processes to the printed sheets.

The above-described embodiments have been illustrated based on the printer 900 adopting an electrophotographic system, but the present embodiments are also applicable to other types of image forming apparatuses, such as an ink-jet image forming apparatus in which images are formed on sheets by discharging ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-090180, filed May 10, 2019, which is hereby incorporated by reference herein in its entirety.

What is claimed is:

1. A photo-interruptor unit comprising:

a photo-interruptor comprising a light emitting component configured to emit light, a photosensing portion configured to receive light emitted from the light emitting component, and a hook portion configured to deform elastically in a deformation direction; and a supporting portion configured to detachably support the photo-interruptor, wherein the supporting portion comprises an attaching surface to which the photo-interruptor is attached, a hole which is formed on the attaching surface and through which the hook portion is inserted in an insertion direction, a guide portion configured to protrude from the attaching surface and configured to guide the hook portion so that the hook portion deforms elastically in the deformation direction in a state where the photo-interruptor is moved in a movement direction intersecting the insertion direction and the deformation direction, and a regulating portion configured to protrude from the attaching surface and to form continuously with the guide portion, and configured to regulate a position in the movement direction of the photo-interruptor whose hook portion has been guided by the guide portion to a position where the hook portion is overlapped with the hole, wherein the guide portion comprises a first rib portion and a second rib portion that are configured to oppose one another in the deformation direction, and a distance between the first rib portion and the second rib portion in the deformation direction become shorter as it goes toward a downstream direction of the movement direction, wherein the hook portion is deformed elastically in the deformation direction by contacting with the first rib portion and the second rib portion, and the hook portion is further deformed elastically in the deformation direction by moving the photo-interruptor toward the downstream direction of the movement direction.

2. The photo-interruptor unit according to claim 1, wherein the hook portion comprises a pair of hooks that are arranged in parallel in the deformation direction, and a distance in the deformation direction between an upstream end of the first rib portion in the movement direction and an upstream end of the second rib portion in the movement direction is greater than a distance between the pair of hooks that are not in an elastically deformed state at a most distant position in the deformation direction.

3. The photo-interruptor unit according to claim 2, wherein the guide portion comprises a position regulating portion configured to oppose the photo-interruptor in a state where the hook portion is inserted to the hole, and configured to regulate a position of the photo-interruptor in the deformation direction, and the position regulating portion is positioned downstream of the first and second rib portions and upstream of the regulating portion in the movement direction.

4. The photo-interruptor unit according to claim 3, wherein the position regulating portion comprises a pair of position regulating surfaces extending in a direction parallel to the insertion direction and the movement direction, and which are arranged with a predetermined distance therebetween in the deformation direction.

5. The photo-interruptor unit according to claim 1, wherein the photo-interruptor comprises a connector portion arranged in line with the light emitting component and the photosensing portion in the movement direction, and having wiring connected thereto, and a distance of the regulating portion from the attaching surface in a state where the photo-interruptor is attached to the supporting portion is greater than a distance from the attaching surface to the connector portion.

6. The photo-interruptor unit according to claim 5, wherein the hook portion, the hole and the guide portion are respectively a first hook portion, a first hole and a first guide portion, the photo-interruptor comprises a second hook portion arranged closer to the connector portion than the first hook portion in the movement direction and configured to deform elastically in the deformation direction, the supporting portion comprises a second hole to which the second hook portion is inserted, and a second guide portion formed to protrude from the attaching surface and configured to guide the second hook portion to deform the second hook portion in the deformation direction, the second guide portion comprises a third rib portion and a fourth rib portion that are arranged to oppose one another in the deformation direction, and a distance between the third rib portion and the fourth rib portion in the deformation direction become shorter toward a downstream direction of the movement direction.

7. The photo-interruptor unit according to claim 6, wherein the regulating portion, the first guide portion and the second guide portion constitute a rib that is formed continuously.

8. The photo-interruptor unit according to claim 7, wherein the photo-interruptor comprises a recessed portion between the light emitting component and the photosensing portion, and in a state where the photo-interruptor is attached to the supporting portion, a distance from the attaching surface of the rib at an area opposed to the recessed portion in the deformation direction is shorter than a distance of the recessed portion from the attaching surface.

9. The photo-interruptor unit according to claim 8, wherein in a state where the photo-interruptor is attached to the supporting portion, the distance, from the attaching surface, of the rib at an area opposed to the light emitting component and the photosensing portion in the deformation direction is greater than the distance of the recessed portion from the attaching surface and shorter than the distance of the light emitting component and the photosensing portion from the attaching surface.

10. The photo-interruptor unit according to claim 1, wherein the supporting portion comprises an opposite surface-side rib that is protruded from an opposite surface that is opposite from the attaching surface of the supporting portion, and in a state where the photo-interruptor is attached to the supporting portion with respect to the opposite surface, the opposite surface-side rib interferes with the photo-interruptor and regulates attachment of the photo-interruptor.

11. A sheet conveyance apparatus comprising:

a conveyance portion configured to convey a sheet;

a moving unit configured to be pressed and moved by the sheet conveyed by the conveyance portion, and configured to block light emitted from the light emitting component to the photosensing portion; and the photo-interruptor unit according to claim 1, configured to output a detection signal when detecting the sheet according to a photosensing state of the light emitted from the light emitting component by the photosensing portion.

12. An image forming apparatus comprising:

an image forming unit configured to form an image on a sheet; and the sheet conveyance apparatus according to claim 11.

* * * * *